US005542634A

United States Patent [19]

Pomerantz

[11] Patent Number: 5,542,634

[45] Date of Patent: Aug. 6, 1996

[54] ADHESIVE HANG TAB

[76] Inventor: Carl Pomerantz, 4589 7th Street, Laval, Quebec, Canada, H7W 2B6

[21] Appl. No.: 497,781

[22] Filed: Jul. 3, 1995

Related U.S. Application Data

[63] Continuation-in-part of Ser. No. 172,763, Dec. 27, 1993, abandoned.

[51] Int. Cl.[6] ..... H04N 5/232

[52] U.S. Cl. ..... 248/214; 248/205.3; 383/22

[58] Field of Search ..... 248/205.3, 214, 248/683; 215/100 R, 100 A; 220/751; 383/22 X, 23, 24; 40/310

[56] References Cited

U.S. PATENT DOCUMENTS

| | | | |
|---|---|---|---|
| 2,635,604 | 4/1953 | Fredrickson | 215/100 R |
| 2,920,779 | 1/1960 | Armitage | 215/100 R |
| 3,620,410 | 11/1971 | Griese, Jr. | 215/100 A |
| 4,016,977 | 4/1977 | Krautsack | 248/205.3 X |
| 4,396,128 | 8/1983 | Larson et al. | 215/100 A |
| 4,832,301 | 5/1989 | Hiromoto et al. | 248/205.3 X |
| 4,863,128 | 9/1989 | Good | 248/205.3 |
| 5,135,125 | 8/1992 | Andel et al. | 215/100 A |
| 5,328,137 | 7/1994 | Miller et al. | 248/205.3 X |

*Primary Examiner*—Alvin C. Chin-Shue
*Assistant Examiner*—Korie H. Chan
*Attorney, Agent, or Firm*—Mila Shvartsman

[57] ABSTRACT

The present invention relates to an adhesive hang tab of flexible material having a pressure sensitive coating provided on at least one of its two surfaces along a longitudinally extending zone extending at predetermined height of the full height of the hang tab. A non-coated portion of this tab having a central aperture adapted for secure hanging of an object attached to the tab. The tab comprises at least two channels or slots extending downwardly from non-coated area into coated area, wherein upper ends of channels being extended directly into the central aperture. Lower portions of channels having a shape facilitating to provide peel resistance and to prevent further propagation or tearing of the hang tab caused by force of gravity created by the object attached to the tab when in use. The hang tab also comprises a protective paper liner covering coated area and extending into non-coated area. New method of making hang tab is also described.

8 Claims, 1 Drawing Sheet

ADHESIVE HANG TAB

This application is a continuation-in-part, of application Ser. No. 08/172,763, filed Dec. 27, 1993, now abandoned.

The present invention is related to a peel-resistant pressure sensitive hang tab and more particularly to a hang tab made from flexible material having sufficient transparency to be secured to a package without concealing printed matter thereon.

Adhesive hang tabs have been in use for same time. However, previously, in order to accomplish manufacture by a common low cost piece of equipment, i.e. a standard, non-precision punch press, the structure of the final product had to be compromised with regard to peel resistant slits and extended paper liners.

Desirable tooling used for a common punch press is a male-female type punching die, wherein the depth of the stroke does not need to be controlled with extreme accuracy, and therefore the die/tool can easily be transferred and adapted to many different models of machine, thereby making the process of manufacture more versatile and requires less expertise to operate and maintain, and therefore is more, flexible and cost effective.

There is knows U.S. Pat. No. 3,884,443 related to a peel-resistant pressure sensitive hanger having slits extending into the coated area from the bare portion to provide a flap which is sprung from the plane of the remainder wherein a tie-down adhesive area will be left behind extending in that plane generally in the direction the flap extends from its root with a free end relatively unaffected by the sprung action to provide peel resistance when applied to a flat surface.

The process of manufacturing hangers described in above mentioned U.S. Pat. No. 3,884,443 requires using specialized, sophisticated equipment in view of the presence of slits which increase peel-resistant properties of the final product. Specifically the depth of the cut of the cutting blade or die in the process of manufacture needs to be controlled with extreme accuracy in order to cut through the material to produce slits without ruining the cutting blade or die. Furthermore, the tool itself, due to this configuration is relatively fragile. Besides, it was not practical to include slits in standard punch press manufacture without adding significant costs to the equipment required to produce this effect.

Furthermore, if the tabs are desired to be in loose/single form, it is highly desirable to include an extended protective paper liner over the adhesive portion to facilitate and expedite peeling of said paper before the final use.

It is also advantageous for the central hole to be located directly adjacent to the adhesive area. However, in order to use a simple punch press process of manufacture, it is critical that there are no loose scrap papers that could dull or impede the process or damage the tool.

As a result in previous configurations of the hang tab using a standard punch process,, an extended protective paper liner could not be provided if the paper liner extended above the base of the central hole, without resulting in a loose, unattached paper which would then interfere and impede the production process, and potentially lead to damaging the tool.

The proposed invention allows to eliminate all disadvantages of the previously known processes and provide simple, flexible, cost effective manufacture of a hang tab having increased peel-resistance, resistance to tearing and easy to use structure.

SUMMARY OF THE INVENTION

Broadly the present invention is related to an adhesive hang tab having two opposite surfaces, a lower portion of one of those two surfaces having a pressure-sensitive coating extending upwardly on predetermined height of a full a full height of the hang tab, a non-coated portion of said tab having a central aperture adapted for secure hanging of an object attached to said tab, said hang tab comprising:

at least two channels or slots extending downwardly from said non-coated area into said coated area, wherein upper ends of said channels being extended directly into said central aperture and wherein lower portions of said channels having a shape facilitating to provide peel resistance and to prevent further propagation or tearing of said hang tab caused by force of gravity created by the object attached to said tab and wherein when in use said upper non-coated portion is oriented in vertical plan and remains substantially undeformed.

It is one of the objects of the present invention that peel resistance and tear resistance of said tab is provided by means of delocalizing the pressure applied to areas around the lower portions of said channels, said channels being of sufficient length and width and wherein said channels being spaced from each other and from outer edges of said tab on predetermined distance to facilitate better peel resistance when in use. The ratio of length to width of said channels is not more than 5 to 1. A lower edge of said central aperture is located substantially adjacent to said coated area. Said hang Tab further comprising a protective paper liner covering said coated area, wherein said paper liner being extended from said coated area into said non-coated area to facilitated easy peeling of said liner before use. The upper ends of said channels being extended directly into a lower edge of said central aperture. Base parts of said lower portions having rounded edges to arrest further propagation of said channels into said coated area.

Yet another object of this invention is the process of manufacture of an adhesive hang tab of flexible material comprising the following steps:

applying an adhesive coating of predetermined width on one of the surfaces of a strip of flexible material;

applying a protective paper liner above said coated area, wherein said liner being extended from said coated area into a non-coated area;

advancing the strip into a punching die unit until said strip is in predetermined position under a first die head;

punching out simultaneously by said first die head the areas of a central aperture adapted for hanging said tab with an attached object and channels or slots extended from said non-coated area into said coated area, wherein fragments of a protective liner located directly over said channels and over a non-coated space between said channels being punched out and removed together with a central part and channel portions to eliminate any free floating pieces of paper;

further advancing the strip under a second die head adapted to separate said hang tab from said strip. Said central part and said channel portions are being removed in one piece and said fragments of protective paper liner are anchored to coated areas of said channel portions.

DESCRIPTION OF THE PREFERRED EMBODIMENT

Figure 1:
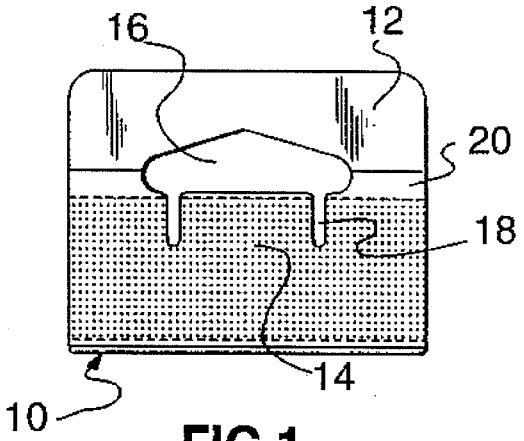
FIG. 1 is a face view of the hang tab according to present invention.
Figure 2:
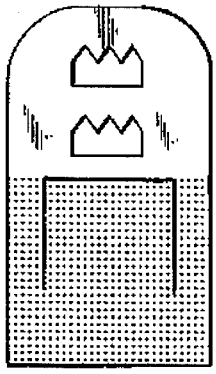
FIG.2 PRIOR ART
FIG. 2 is a face view of the hang tab of THE PRIOR ART.
Figure 3:
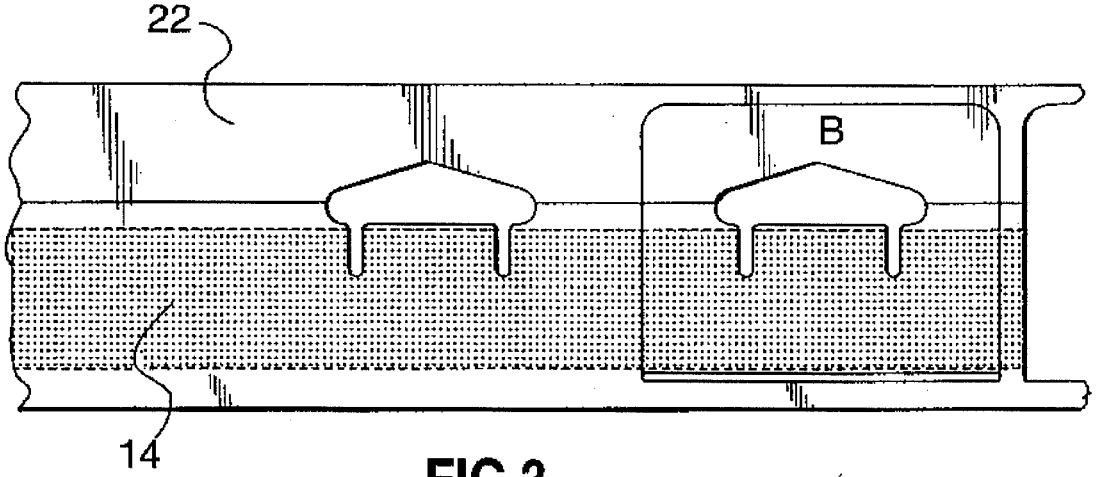
FIG. 3 is a face view of the strip of the hang tabs showing the second step of die cutting the tab out of the strip.
Figure 4:
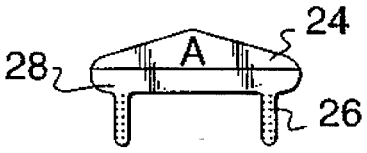
FIG. 4 is a face view of the central part including channels removed out the central portion of the hang tab.

FIGS. 1, 3 and 4 shows the structure of the proposed new hang tab which is manufactured according to the new process. The hang tab 1 comprises a non-coated area 12 and coated area 14. A central hole or aperture 16 is adapted for secure hanging of an object attached to the tab 10 by means of any protruding elements, such as hook or the like. The tab further comprises two channels or slots 18 extending downwardly from said non-coated area 12 to a coated area 14. Upper ends of channels 18 are extended directly into said central aperture 16, preferably into its lower edge. Lower portions of channels 18 having a shape facilitating to provide peel resistance and to prevent further propagation or tearing of tab 10 caused by force of gravity created by the object attached to said tab when in use. The shape of the lower parts of channels 18 allows to delocalize the pressure applied to the areas around the lower portions. Preferably the lower portions of channels 18 have rounded edges which benefit both:

to delocalize pressure and to simplify the process of manufacture. The result of delocalizing the pressure due to a specific shape of lower parts of channels 18 could be compared to a measure taken to prevent further propagation of a crack in the wings of airplane or hull of a sea liner, wherein the hole drilled at the root of the crack will stop this crack to propagate beyond the hole. Channels 18 should be of sufficient length and width, and they should be spaced from each other and from outer edges of said tab 10 on predetermined distance to facilitate better peel resistance when in use. As it is shown in FIG. 1, channels 18 form a central portion located therebetween. When peeling begins, it occurs around the outer edge portions of the tab, and then is arrested beyond that point because the presence of channels and of the central anchor portion located between the two channels. Preferably for tool durability the ratio of length to width of said channels is not more than 5 to 1. It is also preferable that the lower edge of the aperture 16 is located substantially adjacent to a coated area 14.

According to the present invention hang tab 10 further comprises a protective paper liner 20 covering the coated area 14 and being extended into the non-coated area 12 to facilitate easy peeling of said liner before the use. The structure of the hang tab 10 substantially reduces the tendency of the hang tab to come loose due to a gradual peeling under the force of gravity, when supporting an object of considerable weight, such as several video tapes or the like. In use, the upper non-coated portion 12 is oriented in vertical plane and remains substantially undeformed, which is explained by the fact that even though the material from which tab is made is flexible, it has enough rigidity to withstand any deformation of said upper portion 12 caused by weight of the object attached to it. In this case, the central portion located between channels 18 in use is flexing away from the vertical plane. When applied to the object, the upper non-coated portion 12 extends above the top of said object.

The material from which the tab is made must be rigid enough so that the upper portion does not buckle or deform substantially when the tab and package are hung from the hook. If the tab were made of flexible material, it would immediately buckle under this load, and the channels would not function. Furthermore, the peeling mechanism and transmission of surface forces between the tab and the package would be substantially different if the tab material were non-rigid. Thus, it is very important feature of the resent invention that the tab material must have enough rigidity to not buckle at the top portion when supporting product, and in the same time have enough flex in it so that the peeling "front" can be contained in the area outside the channels.

The other advantages of the present invention will be understood after describing the proposed new process of manufacture. A strip of substantially transparent plastic 22, overlaid with an adhesive coating 14 and with extended protective paper liner 20 is fed into a punching die unit (not shown) until the strip is under the die head. In step one, starting from the initial position, a male die with cross section of "A" penetrates the strip 22, and extends into a female cavity of cross-section "A", thereby removing part "A" as shown on FIG. 4. The male die then returns to its initial position. Part "A" which comprises a central portion 24 and channel portions 26 with attached paper liner portion 28 is a scrap. However, due to the existence and configuration of the two channel parts 26, the extended paper liner 28 is firmly attached to part "A" by the adhesive portions of the lower areas of channel parts 26. As a result, during production, the components of plastic, adhesive and extended paper liner remain anchored or stuck together on waste part "A" and are easily removed out of the path of the production process.

If the channel portions 26 are not present in their current form, the extended paper liner 28 would not adhere to the part "A", and thus, would not be anchored and would be free to float off of the plastic piece "A". During the manufacturing process, these loose particles of papers would be difficult to control and remove out of the production process due to suction forces created by the male-female punching die. Therefore, these free particles would substantially interfere with and hamper the process, and would wear and potentially damage the tooling rendering it unsuited for mass production at an efficient cost and rate.

The configuration of the channels 18 is critical to achieve efficiency in this production process. The channels extend downwards and are sized long enough so that they extend into the adhesive portion of the strip, ensuring that the extended paper liner 28 on part "A" is firmly anchored to the piece. Then, the remains attached to the plastic punched out part "A" can fall by force of gravity out of way. In order to achieve durability and longevity of the male punching die with cross section A, the ratio of length to width of the channels 18 is restricted to not more than 5:1.

If the channels 18 were more slender, the punch and die would be significantly less durable, and prone to faster wear and easy breakage during production.

However, in order for the channels 18 to be effective in helping to resist peeling in the finished hang tab 10, the channels 18 need to be of sufficient length and to extend from each other or from the outside edges of the final part. In order to achieve this final product characteristic, while achieving tool durability and production efficiencies, and to minimize the cost of the tool and make it less prone to breakage, the channels 18 extend directly to the center aperture 16.

As a result of this configuration, the process advantages are achieved, such as: compatibility with a standard punch press, absence of loose particles of paper, durability of tooling, in combination with the improved peel-resistant behavioral characteristics and resistance to tearing of the final product and its easy-peeling extended paper liner.

Once step one of the process is completed, the strip 22 is fed further under the die head until the portion with aperture A is centered under the die head B (not shown). As it is shown on FIG. 3, in step 2, starting from its initial position, a male die with cross section of "B" penetrates the strip, and extends into a female cavity of section B, thereby removing part B. The male die then returns to its initial position wherein part B is the final hang tab 10.

Numerous and varied other arrangements may be utilized by those skilled in the art without departing from the spirit and scope of the invention.

I claim:

1. Adhesive hang tab for hanging an object to a support, said hanging tab having two opposite surfaces, a lower portion of one of those two surfaces having a pressure-sensitive coating extending upwardly on predetermined height of a full height of the hang tab adapted for attachment to said object, a non-coated upper portion of said tab having a central aperture adapted for secure hanging of said object onto said support, said hang tab comprising:

at least two channels extending downwardly from said non-coated portion into said coated portion;

upper ends of said channels being extended directly into said central aperture;

lower portions of said channels having means for preventing further propagation or tearing of said hang tab caused by force of gravity created by the object attached to said tab, and wherein when in use said upper non-coated portion is oriented in vertical plane and remains substantially undeformed.

2. A hang tab according to claim 1, wherein said channels forming a central portion located therebetween and wherein when in use said central portion is flexing away from the vertical plane.

3. A hang tab according to claim 1, wherein the lower portions of said channels having rounded edges to arrest further propagation of said channels into said coated area and to delocalize the pressure applied to areas around the lower portions of said channels.

4. A hang tab according to claim 1, wherein said channels being of sufficient width and being spaced apart from each other and from outer edges of said tab on predetermined distance to facilitate better resistance to peeling when in use, and wherein the ratio of length to width of said channels is not more than 5 to 1.

5. A hang tab according to claim 1, wherein a lower edge of said central aperture is located substantially adjacent to said coated portion.

6. A hang tab according to claim 1, wherein said hang tab further comprising a protective paper liner covering said coated portion, wherein said paper liner being extended from said coated portion into said non-coated portion to facilitate easy removal of said liner before the use.

7. A hang tab according to claim 1, wherein the upper ends of said channels being extended directly into a lower edge of said central aperture.

8. A hang tab according to claim 1, wherein when applied to the object, said upper non-coated portion adapted to extend above a top of said object.

* * * * *